US006530495B1

(12) United States Patent
Joseph

(10) Patent No.: US 6,530,495 B1
(45) Date of Patent: Mar. 11, 2003

(54) STORAGE CONTAINER WITH MULTIPLE DIVIDED COMPARTMENTS

(76) Inventor: June G. Joseph, 4706 Calico Ct., Charlotte, NC (US) 28212

( * ) Notice: Subject to any disclaimer, the term of this patent is extended or adjusted under 35 U.S.C. 154(b) by 0 days.

(21) Appl. No.: 10/016,050

(22) Filed: Dec. 6, 2001

(51) Int. Cl.[7] ..... B65D 25/00
(52) U.S. Cl. ..... 220/553; 220/669
(58) Field of Search ..... 220/553, 500, 220/669, 675, 909

(56) References Cited

U.S. PATENT DOCUMENTS 5,072,852 A * 12/1991 Smith et al. ..... 220/909 X
5,916,611 A * 6/1999 Bell ..... 220/669 X
6,308,379 B1 * 10/2001 Hendrickson et al. ..... 220/669

* cited by examiner

*Primary Examiner*—Steven Pollard
(74) *Attorney, Agent, or Firm*—Adams, Schwartz & Evans, P.A.

(57) ABSTRACT

A divided storage container includes an elongated arcuate base having first and second rounded ends, and opposing inwardly and outwardly curved perimeter portions extending between the ends. An upstanding container wall cooperates.with the base to define an enclosure having an open top for receiving items for storage. The container wall has a concave surface extending upwardly from the inwardly curved perimeter portion of the base to the open top of the enclosure. A vertical divider is attached to the container wall for dividing the enclosure into separate adjacent compartments. A supplemental item holder is attached to the concave surface of the container wall outside of the enclosure, and defines a third compartment for receiving and storing items. The first and second ends of the arcuate base cooperate to stabilize the container on a supporting surface when the third compartment is filled.

15 Claims, 4 Drawing Sheets

STORAGE CONTAINER WITH MULTIPLE DIVIDED COMPARTMENTS

TECHNICAL FIELD AND BACKGROUND OF INVENTION

This application relates to a storage container with multiple divided compartments. The invention is especially applicable for separating and storing various recyclable items prior to collection. The invention includes multiple compartments for containing items such as glass bottles, plastic bottles and jugs, and newspaper. The invention's unique configuration provides a stable and balanced structure when filled. The convenience of the invention promotes recycling, and saves the time and effort required to separate different types of recyclables for curbside collection. In other applications, the invention may be used, for example, in the lobby of a business office for storing items such as umbrellas and magazines.

SUMMARY OF INVENTION

Therefore, it is an object of the invention to provide a storage container with multiple divided compartments applicable for storing different types of recyclable items prior to curbside collection.

It is another object of the invention to provide a storage container which is stable and balanced with filled.

It is another object of the invention to provide a storage container which promotes recycling.

These and other objects of the present invention are achieved in the preferred embodiments disclosed below by providing a divided storage container including an elongated arcuate base having first and second rounded ends, and opposing inwardly and outwardly curved perimeter portions extending between the ends. An upstanding container wall cooperates with the base to define an enclosure having an open top for receiving items for storage. The container wall has a concave surface extending upwardly from the inwardly curved perimeter portion of the base to the open top of the enclosure. A vertical divider is attached to the container wall for dividing the enclosure into separate adjacent compartments. A supplemental item holder is attached to the concave surface of the container wall outside of the enclosure, and defines a third compartment for receiving and storing items. The first and second ends of the arcuate base cooperate to stabilize the container on a supporting surface when the third compartment is filled.

According to another preferred embodiment of the invention, the divider extends vertically from the base to the open top of the enclosure.

According to another preferred embodiment of the invention, the divider extends laterally across the base from the inwardly curved perimeter portion to the outwardly curved perimeter portion.

According to another preferred embodiment of the invention, the divider is located at a center of the enclosure.

According to another preferred embodiment of the invention, the inwardly curved perimeter portion of the base defines a radius of between 6 and 8 inches.

According to another preferred embodiment of the invention, the outwardly curved perimeter portion of the base defines a radius of between 6 and 8 inches.

According to another preferred embodiment of the invention, the supplemental item holder includes a basket having a supporting top frame member and a mesh basket wall attached to the concave surface of the container wall.

According to another preferred embodiment of the invention, a container lid is provided for covering the open top of the enclosure.

According to another preferred embodiment of the invention, the lid is pivotally attached to a top of the container wall.

According to another preferred embodiment of the invention, a foot pedal is located adjacent the base and operatively connected to the pivoted lid for opening and closing the lid.

In another embodiment, the invention is a method of segregating recyclable items for storage prior to collection. The method includes the steps of placing a first type of recyclable item into a first compartment of a divided storage container. The divided storage container includes an elongated arcuate base having first and second rounded ends, and opposing inwardly and outwardly curved perimeter portions extending between the ends. An upstanding container wall cooperates with the base to define an enclosure having an open top for receiving items for storage. A second type of recyclable item is placed into a second compartment of the divided storage container. The second compartment is formed adjacent the first compartment within the enclosure. A third type of recyclable item is placed into a supplemental item holder attached to a concave surface of the container wall outside of the enclosure. The supplemental item holder defines a third compartment for receiving and storing items. The first and second ends of the arcuate base cooperate to stabilize the container on a supporting surface when the third compartment is filled.

According to another preferred embodiment of the invention, the first type of recyclable item includes glass items.

According to another preferred embodiment of the invention, the second type of recyclable item includes plastic items.

According to another preferred embodiment of the invention, the third type of recyclable item includes paper items.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
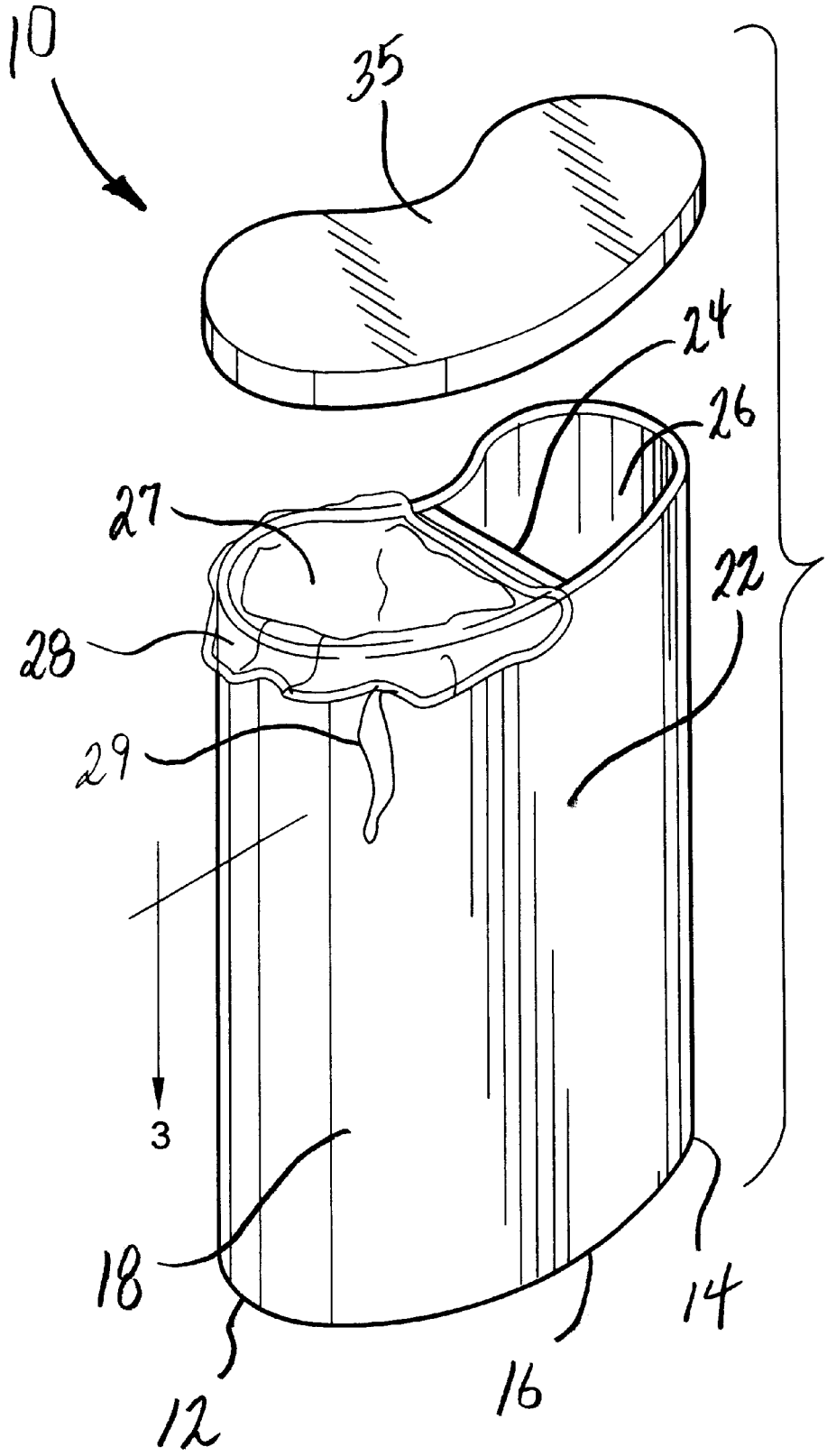
FIG. 1 is a perspective view of a multiple compartment storage container according to one preferred embodiment of the present invention.

Referring now specifically to the drawings, a multiple compartment storage container according to the present invention is illustrated in FIG. 1, and shown generally at reference numeral 10. The container 10 is especially applicable for storing recyclable items, such as glass, plastic, and paper, prior to collection. The container 10 is manufactured of molded plastic or metal, and may be provided in several different sizes.

Referring to FIGS. 1–4, the container 10 includes an elongated, kidney-bean-shaped base 11 having first and second rounded ends 12 and 14, and opposing inwardly and outwardly curved perimeter portions 15 and 16. For a container 2 feet tall and 18–24 inches wide, the curve radius of the perimeter portions 15, 16 is preferably between 6 and 8 inches. The curve radius of the rounded ends 12, 14 is between 3 and 4 inches. An upstanding container wall 18 is formed with the base 11, and has a concave surface 21 extending from the inwardly curved portion 15 of the base 11 and an opposing convex surface 22 extending from the outwardly curved portion 16. The container wall 18 and base 11 cooperate to define an enclosure with an open top for receiving recyclable items.

Figure 3:
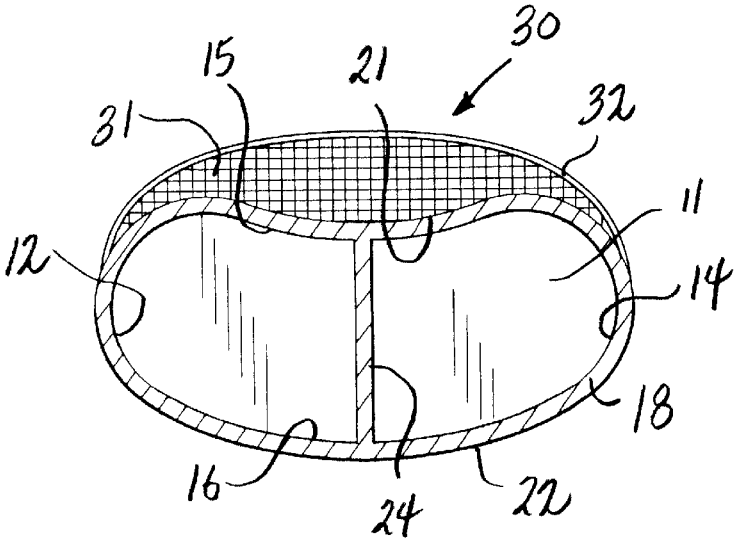
FIG. 3 is cross-section of the storage container taken substantially along line 3—3 of FIG. 2.
Figure 4:
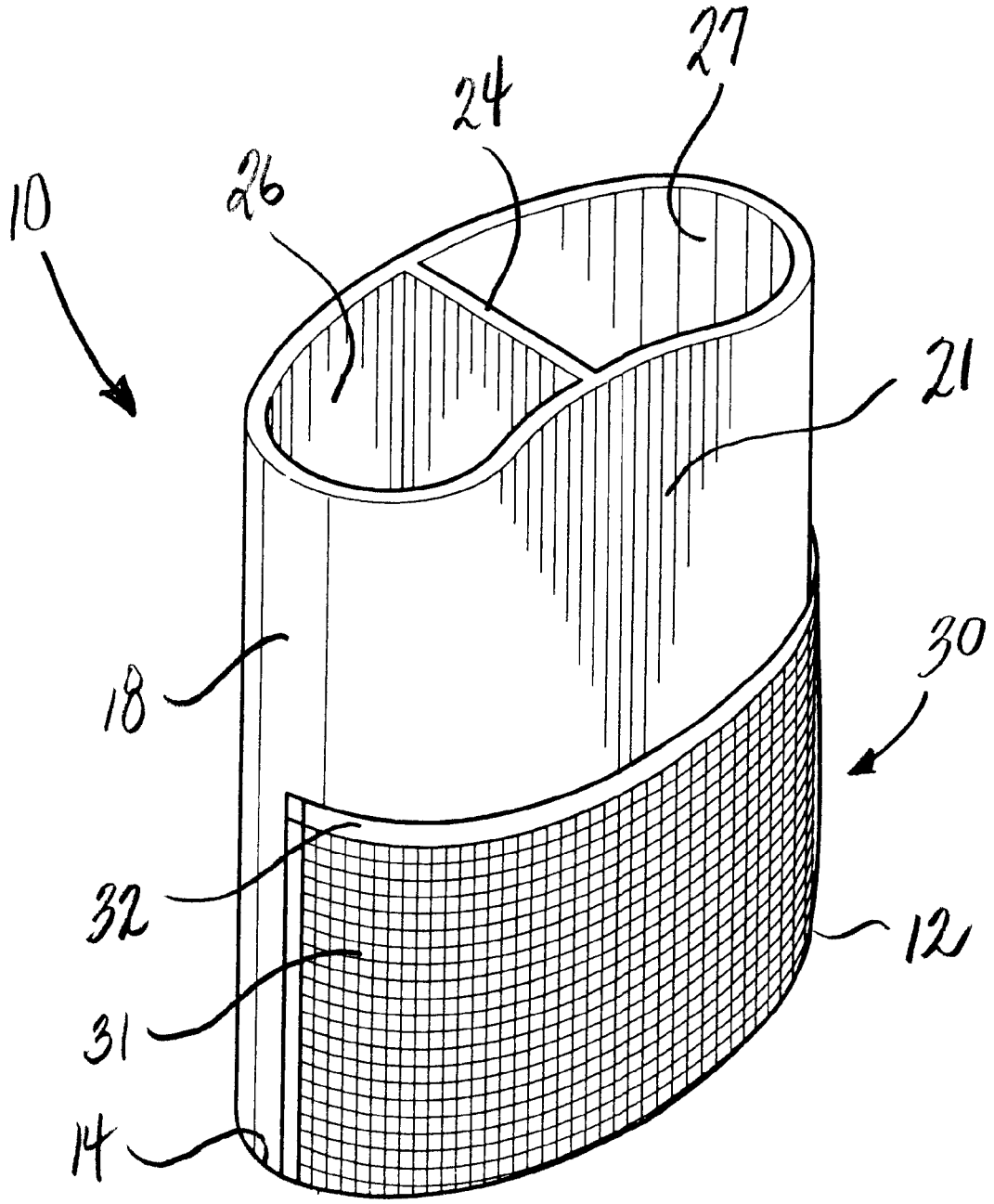
FIG. 4 is a perspective view of the storage container showing the basket formed with the concave surface of the container wall.

As shown in FIGS. 1, 3, and 4, a vertical divider 24 is centrally located within the enclosure between the concave and convex surfaces 21 and 22 of the container wall 18 to form separate adjacent compartments 26 and 27. The compartments 26 and 27 are used for separately storing different types of recyclable items, such as glass and plastic. The divider 24 is preferably integrally molded with the container wall 18 and extends from the base 11 of the container 10 to the open top of the enclosure. In an alternative embodiment, the divider 24 is removably inserted between opposing vertical grooves (not shown) formed in the container wall 18. Disposable plastic bags 28 fit inside each of the compartments 26, 27 for removing the collected items for placement at the curbside for municipal collection. For added convenience, a number of spaced hooks (not shown) may be formed around the outside of the container wall 18 near the open top to secure the bags 28 in the compartments 26, 27. Preferably, the bags 28 have drawstrings 29 which close the bags when filled.

Figure 2:
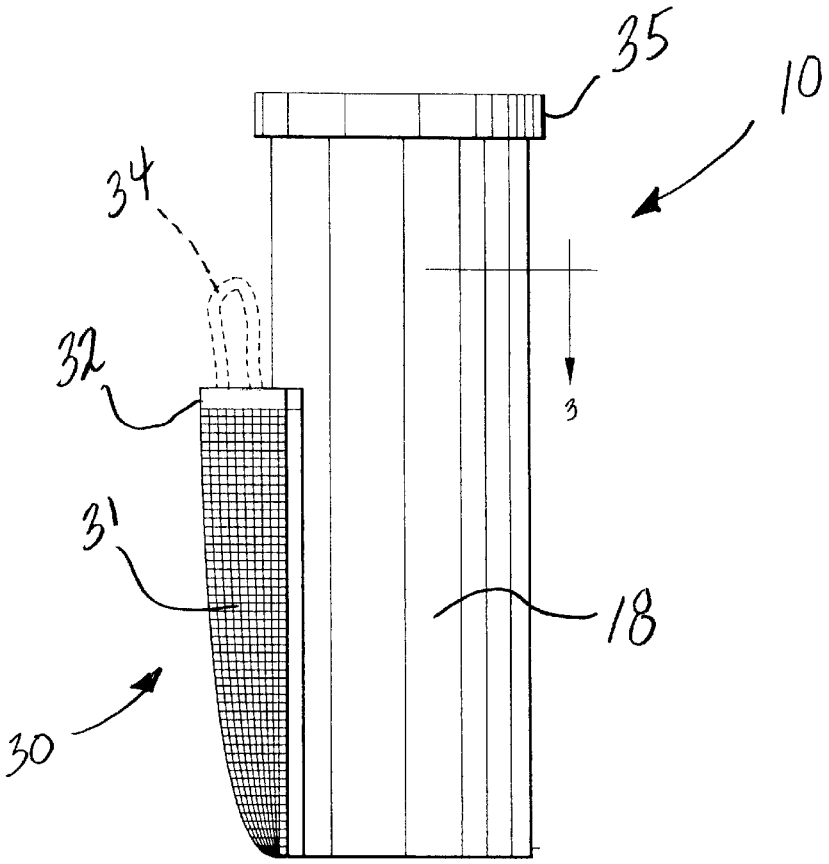
FIG. 2 is side elevation of the storage container.

As shown in FIGS. 2, 3, and 4, a supplemental item holder 30 is attached to the concave surface 21 of the container wall 18 outside of the enclosure. The item holder 30 is preferably a mesh basket 31 with a top support frame 32 which is integrally molded with the container wall 18. The basket 31 defines a third compartment for receiving and storing items, such as recyclable paper products 34. When the basket 31 is filled, the first and second rounded ends 12, 14 of the kidney-bean-shaped base 11 cooperate to stabilize the container 10 and prevent it from toppling in the direction of the basket 31.

Figure 5:
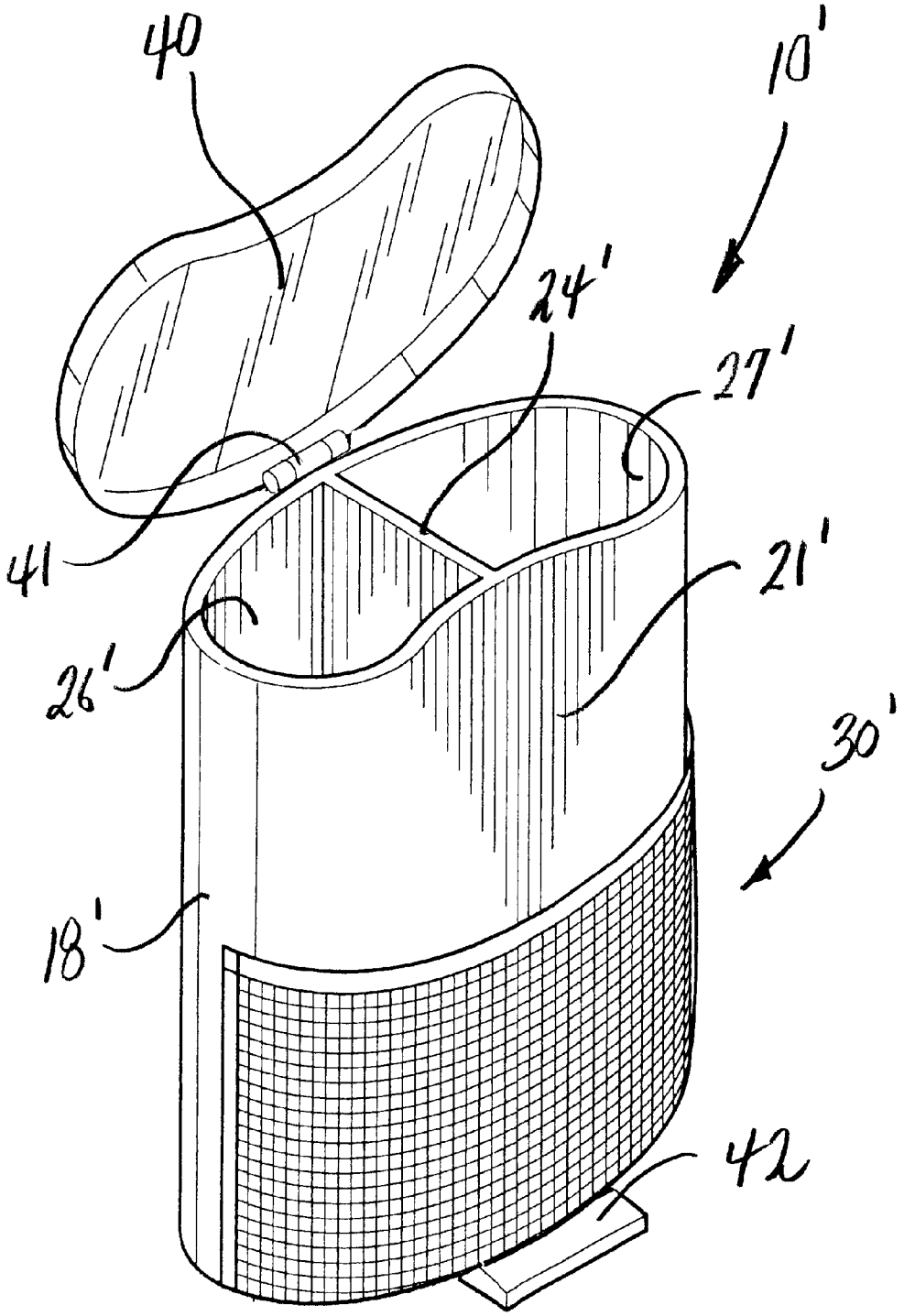
FIG. 5 is a perspective view of the storage container according to a second preferred embodiment of the invention.

A removable lid 35 is provided for closing the open top of the container 10, as shown in FIGS. 1 and 2. In an alternative embodiment of the container 10', shown in FIG. 5, the lid 40 is ally attached by a hinge 41 at the top edge of the container wall 18'. The lid 40 is actuated by a conventional foot pedal 42 and linkage (not shown). The container 10' includes each of the elements and features of the container 10 previously described. Like elements shown in FIG. 5 and described above are indicated in prime notation.

A storage container is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A divided storage container, comprising:

(a) an elongated arcuate base having first and second rounded ends, and opposing inwardly and outwardly curved perimeter portions extending between said ends;

(b) an upstanding container wall cooperating with said base to define an enclosure having an open top for receiving items for storage, said container wall comprising a concave surface extending upwardly from the inwardly curved perimeter portion of said base to the open top of said enclosure;

(c) a vertical divider attached to said container wall for dividing said enclosure into separate adjacent compartments; and (d) a supplemental item holder attached to the concave surface of said container wall outside of said enclosure, and defining a third compartment for receiving and storing items, whereby the first and second ends of said arcuate base cooperate to stabilize the container on a supporting surface when the third compartment is filled.

2. A storage container according to claim 1, wherein said divider extends vertically from said base to the open top of said enclosure.

3. A storage container according to claim 2, wherein said divider extends laterally across said base from the inwardly curved perimeter portion to the outwardly curved perimeter portion.

4. A storage container according to claim 3, wherein said divider is located at a center of said enclosure.

5. A storage container according to claim 1, wherein the inwardly curved perimeter portion of said base defines a radius of between 6 and 8 inches.

6. A storage container according to claim 1, wherein the outwardly curved perimeter portion of said base defines a radius of between 6 and 8 inches.

7. A storage container according to claim 1, wherein said supplemental item holder comprises a basket having a supporting top frame member and a mesh basket wall attached to the concave surface of said container wall.

8. A storage container according to claim 1, and comprising a container lid adapted for covering the open top of said enclosure.

9. A storage container according to claim 8, wherein said lid is pivotally attached to said container wall.

10. A storage container according to claim 9, and comprising a foot pedal located adjacent said base and operatively connected to said pivoted lid for opening and closing said lid.

11. A method of segregating recyclable items for storage prior to collection, comprising the steps of:

(a) placing a first type of recyclable item into a first compartment of a divided storage container, the divided storage container comprising an elongated arcuate base having first and second rounded ends, and opposing inwardly and outwardly curved perimeter portions extending between the ends, and an upstanding container wall cooperating with the base to define an enclosure having an open top for receiving items for storage;

(b) placing a second type of recyclable item into a second compartment of the divided storage container, the second compartment being formed adjacent the first compartment within the enclosure; and (c) placing a third type of recyclable item into a supplemental item holder attached to a concave surface of the container wall outside of the enclosure, the supplemental item holder defining a third compartment for receiving and storing items, whereby the first and second ends of the arcuate base cooperate to stabilize the container on a supporting surface when the third compartment is filled.

12. A method according to claim 11, wherein the first type of recyclable item comprises glass items.

13. A method according to claim 11, wherein the second type of recyclable item comprises plastic items.

14. A method according to claim 11, wherein the third type of recyclable item comprises paper items.

15. A method of segregating recyclable items for storage prior to collection, comprising the steps of:

(a) placing glass recyclable items into a first compartment of a divided storage container, the divided storage container comprising an elongated arcuate base having first and second rounded ends, and opposing inwardly and outwardly curved perimeter portions extending between the ends, and an upstanding container wall cooperating with the base to define an enclosure having an open top for receiving items for storage;

(b) placing plastic recyclable items into a second compartment of the divided storage container, the second compartment being formed adjacent the first compartment within the enclosure; and (c) placing paper recyclable items into a supplemental item holder attached to a concave surface of the container wall outside of the enclosure, the supplemental item holder defining a third compartment for receiving and storing items, whereby the first and second ends of the arcuate base cooperate to stabilize the container on a supporting surface when the third compartment is filled.

* * * * *